United States Patent [19]

Takase et al.

[11] 4,043,114

[45] Aug. 23, 1977

[54] CIRCUITS FOR SETTING THE DISPLAY MODE AND THE CORRECTION MODE OF ELECTRONIC TIMEPIECES

[75] Inventors: Tsuneo Takase; Tetsuo Yamaguchi, both of Yokohama, Japan

[73] Assignee: Tokyo Shibaura Electric Co., Ltd., Kawasaki, Japan

[21] Appl. No.: 633,833

[22] Filed: Nov. 20, 1975

[30] Foreign Application Priority Data

Nov. 21, 1974 Japan ..... 49-133132

[51] Int. Cl.[2] ..... G04B 11/24; G04B 19/30; G04B 27/00

[52] U.S. Cl. ..... 58/23 R; 58/50 R; 58/58; 58/85.5

[58] Field of Search ..... 58/4 A, 39.5, 50 R, 58/58, 23 R, 85.5

[56] References Cited

U.S. PATENT DOCUMENTS

| | | | |
|---|---|---|---|
| 3,788,058 | 1/1974 | Idei | 58/50 R |
| 3,852,950 | 12/1974 | Yoda | 58/85.5 |
| 3,852,952 | 12/1974 | Vittoz | 58/85.5 |

*Primary Examiner*—E. S. Jackmon
*Attorney, Agent, or Firm*—Oblon, Fisher, Spivak, McClelland & Maier

[57] ABSTRACT

The setting circuit comprises first and second switches; a first signal generating circuit which generates a pulse signal each time the first switch is closed; a second signal generating circuit for generating 0 and 1 level output signals from a first output terminal when the second switch is opened and closed and a pulse signal from a second output terminal each time the second switch is opened; a ring counter circuit including cascade connected first to third shift registers each connected to receive the pulse signal from the second signal generating circuit at the reset terminal thereof, said ring counter operating as a 3 digit ring counter when the second switch is opened but as a four digit ring counter when the second switch is closed, thereby producing control signals for setting the display mode and the correction mode of the electronic timepiece from the first output terminal of the signal generating circuit and predetermined output terminals of the ring counter circuit.

8 Claims, 17 Drawing Figures

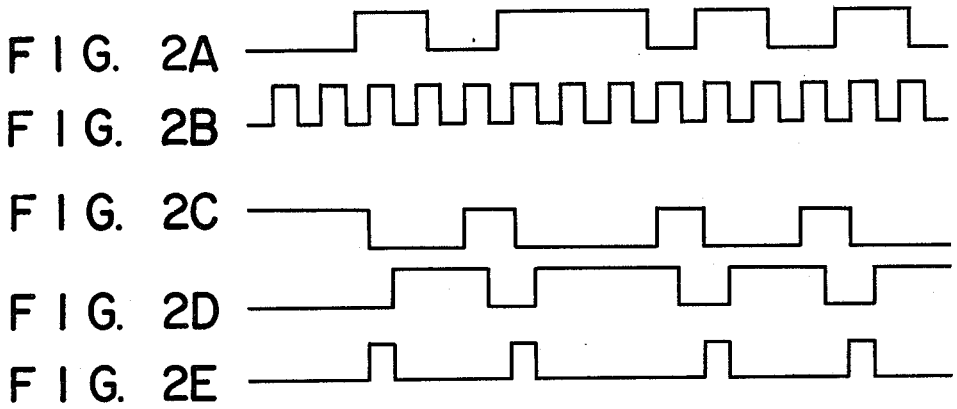
FIG. 2A
FIG. 2B
FIG. 2C
FIG. 2D
FIG. 2E
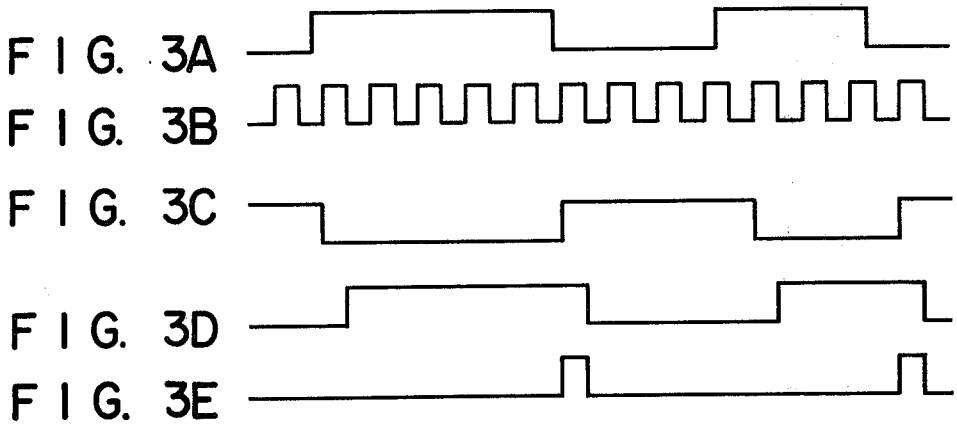
FIG. 3A
FIG. 3B
FIG. 3C
FIG. 3D
FIG. 3E

CIRCUITS FOR SETTING THE DISPLAY MODE AND THE CORRECTION MODE OF ELECTRONIC TIMEPIECES

This invention relates to a circuit for setting the display mode and the correction mode of an electronic timepiece.

With recent development of large scale integrated circuits, conventional mechanical timepieces are now gradually changing to electronic timepieces. Electronic timepieces are classified into a register type and a frequency division type and these both types accompany the problem of time correction. According to one method of correcting the time or changing the date or week day it is usual to selectively operate four switches including a switch for setting the correction mode or a display mode, a digit selection switch for carrying up the hour digit or the like, a switch enabling a correction, and a switch for inhibiting the display or correction.

Of course, use of such many switches renders inconvenient the wearer of the timepiece because a considerable time is necessary for the wearer to satisfactorily operate the switches.

Accordingly, it is an object of this invention to provide an improved circuit for setting the display and the correction modes for an electronic timepiece capable of reducing the number of such switches and can be operated readily.

According to this invention there is provided a circuit for setting the display mode and the correction mode of an electronic timepiece comprising first and second switches; a first signal generating circuit which generates a pulse signal each time the first switch is closed; a second signal generating circuit responsive to the state of operation of the second switch for producing output signals having binary logical levels at a first output terminal, and for producing a pulse signal at a second output terminal each time the second switch is opened; and a ring counter circuit including a plurality of serially connected shift registers which are driven by the pulse signal from the first signal generating circuit and cleared by the pulse signal from the second output terminal of the second signal generating circuit, the ring counter and the second signal generating circuit being constructed and arranged such that the control signals for time display and time correction are derived out from the first output terminal of the second signal generating circuit and predetermined output terminals of the ring counter.

Figure 1:
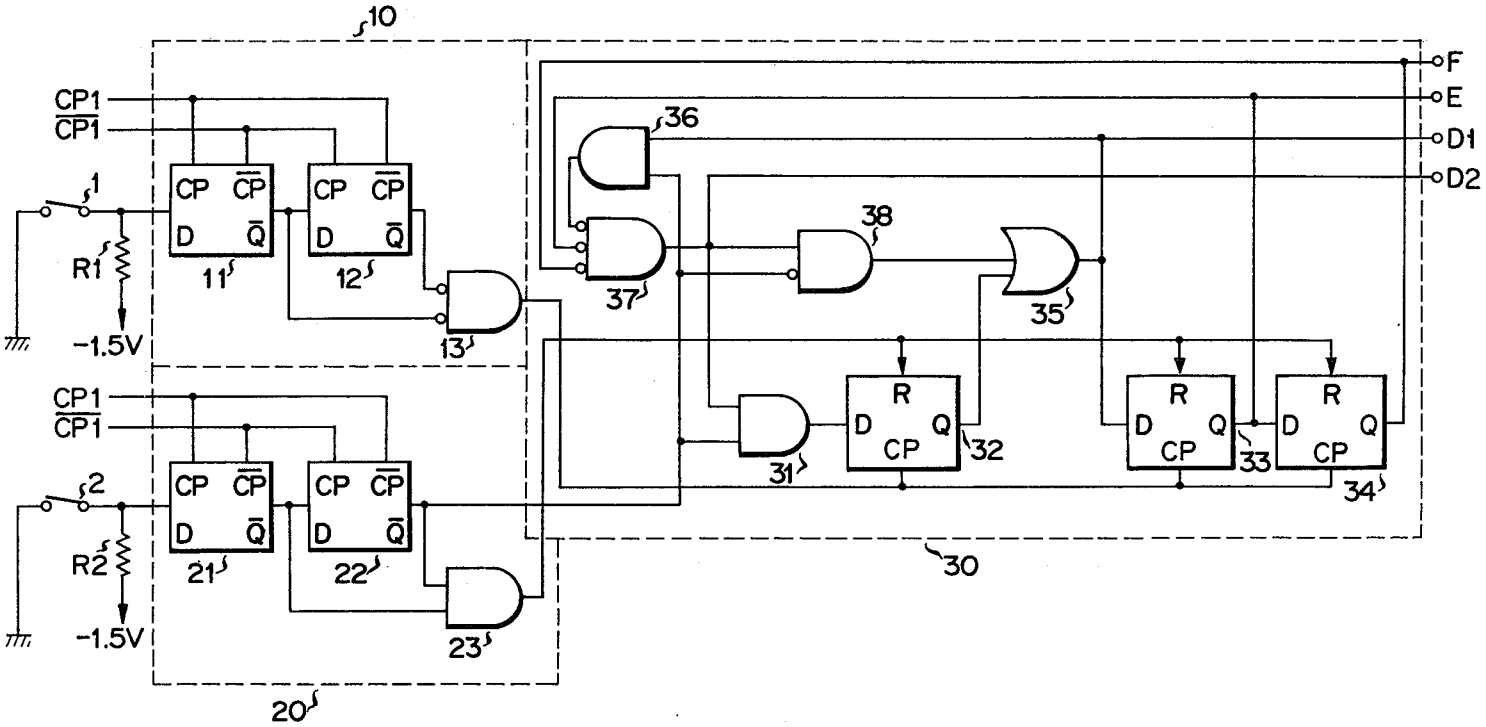

This invention can be more fully understood from the following detailed description when taken in conjunction with the accompanying drawings, in which:

FIG. 1 is a connection diagram showing one embodiment of the novel circuit for setting the display and correction modes of an electronic timepiece; and FIGS. 2A through 2E, FIGS. 3A through 3E and FIGS. 4A through 4F show signal waveforms at various portions of the circuit shown in FIG. 1.

A preferred embodiment of the circuit for setting the display and correction modes shown in FIG. 1 comprises a first switch 1, a second switch 2, a first detection circuit 10 for detecting the operation of the first switch 1, a second detection circuit 20 for detecting the operation of the second switch 2 and a ring counter circuit 30 driven by the detection circuits 10 and 20.

The first detection circuit 10 comprises cascade connected first and second shift registers 11 and 12 driven by clock pulses CP1 and $\overline{CP1}$ each having a frequency of 32 Hz and connected to the first switch 1, and an AND gate circuit 13 having input terminals connected to the output terminals of shift registers 11 and 12 respectively through inverters, not shown. The junction between the first switch 1 and the first shift register 11 is connected to a source of −1.5V via resistor 21.

Consider now a case wherein the switch 1 is operated such that it produces an electric signal as shown in FIG. 2A. More particularly, depression of switch 1 or the change of the electric signal shown in FIG. 2A to the state of 1 level is detected by the positive going transition of the clock pulse CP1 immediately following the closure of switch 1 and having a frequency of 32 Hz as shown in FIG. 2B whereas change of the state to 0 level is detected by the build up portion of the clock pulse CP1 immediately following the opening of the switch whereby the shift register 11 produces an output signal produced by inverting the input signal, or a signal shown in FIG. 2C on its output terminal $\overline{Q}$. Similarly, the output signal from shift register 11 is detected at the negative going transition of the clock pulse CP1, delayed by a predetermined length of time and inverted by shift register 12 thus producing an output signal as shown in FIG. 2D on the output terminal $\overline{Q}$ of shift register 12. The output from shift registers 11 and 12 are applied to the input terminal of AND gate circuit 13 via inverters, whereby this AND gate circuit produces a pulse shown in FIG. 2E each time the switch 1 is closed.

The second detection circuit 20 comprises serially connected third and fourth shift registers 21 and 22 driven by clock pulses CP1 and $\overline{CP1}$ each having a frequency of 32 Hz and an AND gate circuit 23 having input terminals connected to the output terminals $\overline{Q}$ of shift registers 21 and 22. The junction between switch 2 and shift register 21 is connected to a source of −1.5V through a resistor R2.

Suppose now a case wherein switch 2 is operated to generate an electric signal as shown by FIG. 3A. The closed state of the switch 2, or the change of the signal shown in FIG. 3A to 1 level is detected by the positive going transition of the 32 Hz clock pulse CP1 shown in FIG. 3B and immediately following the closure of switch 2, whereas the change of the signal to 0 level is detected by the positive going transition of the clock pulse immediately following the opening of the switch 2. Consequently, as shown in FIG. 3C, a signal corresponding to the inversion of the electric signal shown in FIG. 2A is produced at the output terminal $\overline{Q}$ of the shift register 21. In the same manner, the shift register 22 operates to detect the output signal from shift register 21 at the negative going transition of the clock pulse CP1 and then delays the signal by a predetermined time thereby producing a signal as shown in FIG. 3D on the output terminal $\overline{Q}$. The output signals from shift registers 21 and 22 are applied to the input terminals of the AND gate circuit 23, thus producing a pulse shown in FIG. 2E each time switch 2 is opened.

The ring counter circuit 30 comprises three shift registers 32, 33 and 34 respectively having a CP terminal connected to the output terminal of the AND gate circuit 13 of the first detection circuit 10 and a reset terminal R connected to the output terminal of the AND gate circuit 23 of the second detection circuit 20. The output terminal Q of shift register 32 is connected to one input of an OR gate circuit 35 with the output terminal connected to the input terminal D of the shift register 33 which is connected in series with shift register 34. The output terminal of the OR gate circuit 35 and the output terminal $\overline{Q}$ of shift register 22 are connected to the input terminals of an AND gate circuit 36. The output terminal of this AND gate circuit and the output terminals Q of shift registers 33 and 34 are connected to the input terminals of an AND gate circuit 37 respectively through inverters. The output terminal of AND gate circuit 37 is connected to one input of an AND gate circuit 38 and to one input of an AND gate circuit 31. The other input terminal of the AND gate circuit 38 is connected to the output terminal $\overline{Q}$ of the shift register 22 via an inverter and the output terminal of the AND gate circuit 38 is connected to the other input terminal of the OR gate circuit 35. The other input terminal of the AND gate circuit 31 is connected to the output terminal $\overline{Q}$ of the shift register 22 whereas the output terminal of the AND gate circuit 31 is connected to the input terminal of shift register 32. As will be understood from the following explanation, the AND gate 38 and OR gate 35 function as a bypass circuit for the shift register 32 when the switch 2 is opened.

When switch 2 is open, a 0 level signal is produced at the output terminal $\overline{Q}$ of shift register 22 whereby AND gate circuit 31 is disenabled or closed by this output signal. Under these conditions, since shift registers 33 and 34 are in their reset states the output signals from these shift registers are at the 0 level, respectively. Since AND gate circuit 36 is supplied with the 0 level signal from shift register 22 this AND gate circuit too is disenabled. Consequently, a 0 level signal is applied to the input of AND gate circuit 37 via an inverter whereby this AND gate circuit produces a 1 level output signal. In response to the 1 level output signal from AND gate circuit and the 0 level signal sent from the shift register 22 via the inverter, the AND gate circuit 38 produces a 1 level output signal whereby the operation mode set terminal D1 connected to the output terminal of the AND gate circuit 37 is maintained at the 1 level, the operation mode set terminal D2 connected to the output terminal of the OR gate circuit 35 is maintained at the 1 level, the operation mode set terminal E connected to the output terminal Q of shift register 33 is maintained at the 0 level and the operation mode set terminal F connected to the output terminal Q of the shift register 34 is maintained at the 0 level.

At this time, switch 1 is closed to generate one pulse from the AND gate circuit 13 which is applied to the CP terminals of shift registers 32, 33 and 34, respectively. However, as a 0 level signal is applied to the input terminals D of shift registers 32 and 33, these shift registers produce 0 level signals on their output terminals Q. However, as the 0 level signal is applied to the input terminal D of the shift register 33, this shift register will produce a 1 level output signal when the pulse from the AND gate circuit 13 is applied to its input terminal CP. The 1 level output signal from shift register 33 is applied to one input of the AND gate circuit 37 via the inverter, thereby disenabling this AND gate circuit. Consequently, the operation mode set terminal E is maintained at the 1 level whereas other operation mode set terminals D1, D2 and F are maintained at the 0 level when switch 1 is closed again to produce a pulse from the AND gate circuit 13, a 1 level signal is produced at the output terminal Q of the shift register 34 whereas 0 level signals are produced at the output terminals Q of shift registers 32 and 33. The 1 level output signal from shift register 34 is applied to one input terminal of AND gate circuit 37 via an inverter so as to disenable this AND gate circuit. As a consequence, the operation mode set terminal F is maintained at the 1 level whereas the other operation mode set terminals D1, D2 and E are maintained at the 0 level, respectively.

Figures 4A, 4B, 4C, 4D, 4E, 4F:
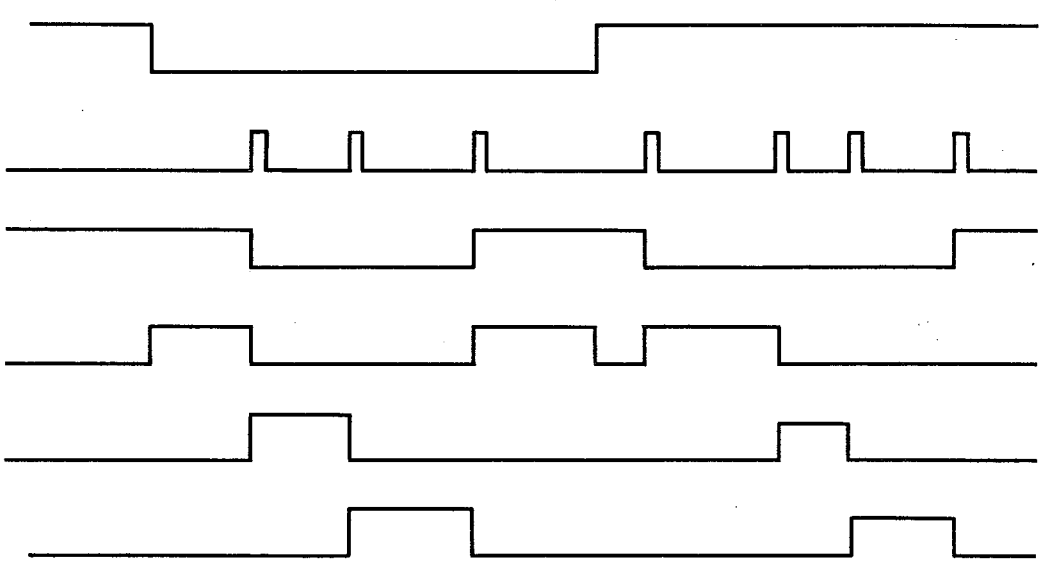

When the switch 1 is closed again a pulse from the AND gate circuit 13 is applied to the input terminal CP of shift register 34 thus producing a 0 level output signal at the output terminal Q of the shift register 34. The 0 level output signals from shift registers 33 and 34 are applied to the input terminals of the AND gate circuit 37 via inverters, thus producing a 1 level output signal from AND gate circuit 37. The 1 level output signal from AND gate circuit 37 is applied to the AND gate circuit 38 together with the 0 level signal from the shift register 22 which is applied through an inverter whereby the AND gate circuit 38 produces a 1 level output signal. Accordingly, the operation mode set terminals D1 and D2 are maintained at the 1 level whereas the other operation mode set terminals E and F are maintained at the 0 level. This condition is the same as that described above. While switch 2 is maintained open, the ring counter circuit 30 operates as a three digit counter driven by the output pulse from the first detection circuit 10. This operation is illustrated by curves shown in FIGS. 4A through 4F. More particularly, FIG. 4A shows the ON and OFF states of the switch 2, FIG. 4B shows the pulse signal generated by the first detection circuit 10, and FIGS. 4C, 4D, 4E and 4F show the signal levels at the operation mode set terminals D1, D2, E and F, respectively.

When switch 2 is closed, a 1 level output signal will be produced by the shift register 22. Under these conditions, since the operation mode set terminals D1 and D2 are maintained at the 1 level and the operation mode set terminals E and F are maintained at the 0 level, the AND gate circuit 31 will produce a 1 level output signal which is applied to the input terminal D of shift register 32. Accordingly, the 0 level output signal from shift register 32 and the 0 level output signal from the AND gate circuit 38 are applied to OR gate circuit 35 thus causing it to produce a 0 level output signal. Thus, the operation mode set terminal D1 is maintained at the 1 level and the other operation mode set terminals D2, E and F are maintained at the 0 level. Under these conditions, when switch 1 is closed to cause AND gate circuit 13 to produce a pulse shift register 32 will produce a 1 level output signal whereas shift registers 33 and 34 will produce 0 level output signals. In response to the 1 level output signals from shift registers 32 and 22, the AND gate circuit 36 produces a 1 level output signal which is applied to one input of the AND gate circuit 37 via an inverter, thereby disenabling AND gate circuit 37. Consequently, the operation mode set terminal D2 is maintained at the 1 level and the other operation mode set terminals D1, E and F are maintained at the 0 level. When the switch 1 is closed next time, shift register 33 produces a 1 level output signal whereas shift registers 32 and 34 produce 0 level output signals, thereby disenabling the AND gate circuit 37. Accordingly, the operation mode set terminal E is maintained at the 1 level and other operation mode set terminals D1, D2 and F are maintained at the 0 level.

Upon closure of the switch 1, shift register 34 produces a 1 level signal for enabling AND gate circuit 37 whereas shift registers 32 and 33 produce 0 level output signals. As a result, the operation mode set terminal F is maintained at the 1 level and the other operation mode set terminals D1, D2 and E are maintained at the 0 level. When the switch 1 is closed again shift registers 32, 33 and 34 produce 1 level output signals thus causing AND gate circuit 37 to produce a 1 level output signal. As a result, the operation mode set terminal D1 is maintained at the 1 level and the other operation mode set terminals D2, E and F are maintained at the 0 level. This state is the same as that obtained when the switch 2 is closed. Accordingly, when the switch 2 is maintained closed, the ring counter circuit 30 operates as a four digit counter.

The states of the operation mode set terminals D1, D2, E and F when the switch 1 is closed intermittently while switch 2 is maintained open are shown by FIGS. 4A through 4F.

As has been described above by the suitable operations of switches 1 and 2 a truth table as shown below can be obtained.

| Set State | Switch 2 | D1 | D2 | E | F | Display mode | Correction mode |
|---|---|---|---|---|---|---|---|
| 1 | OFF | 1 | 1 | 0 | 0 | hour, min. | inhibit |
| 2 | OFF | 0 | 0 | 1 | 0 | date | " |
| 3 | OFF | 0 | 0 | 0 | 1 | second | " |
| 4 | ON | 1 | 0 | 0 | 0 | hour, min. | hour correction |
| 5 | ON | 0 | 1 | 0 | 0 | hour, min. | minute correction |
| 6 | ON | 0 | 0 | 1 | 0 | date | date correction |
| 7 | ON | 0 | 0 | 0 | 1 | second | second correction |

In this truth table, the display mode and the correction mode are determined in accordance with the set states determined by the operation mode set terminals D1, D2, E and F. When switch 2 is maintained OFF, each time the switch 1 is closed, the set states 1–3 are shifted to the succeeding states. When the switch 2 is maintained closed, each time switch 1 is closed, the set states 4–7 are shifted to the states of the next stage. On the other hand, when switch 2 is closed at the set states 1, 2 and 3, these states are shifted to the states 4, 6 and 7, respectively. When switch 2 is opened at the set states of 4–7, AND gate circuit 23 produces a reset pulse of 1/64 second thereby resetting shift registers 32, 33 and 34.

Where it is desired to correct or update a date, since the set state is generally at the 1 state, the preparation operation of the date correction will be completed either by firstly closing switch 2 to establish the set state 4 and then closing switch 2, or by closing once the switch 1 and then closing switch 2. Thus, in response to the signals from the operation mode set terminals D1, D2, E and F the time correction circuit (not shown) of the electronic timepiece is set to the date correction mode. Thereafter, the date can be corrected by operating the date correction circuit.

As has been described hereinabove, according to this invention, it is possible to readily and rapidly set display mode and the correction mode of the electronic timepiece by operating two switches which is convenient for the wearer.

Although the invention has been shown and described in terms of a preferred embodiment thereof, it should be understood that the invention is by no means limited to this specific embodiment. For example, a NOR gate circuit may be substituted for AND gate circuits 13 and 37 provided with inverters at their first stages.

What we claim is:

1. A circuit for setting the display mode and the correction mode of an electronic timepiece comprising first and second switches each having first and second switching positions; a first signal generating circuit which generates a pulse signal each time the first switch is set to the second position; a second signal generating circuit responsive to the switching positions of the second switch for producing an output signal having binary logical levels at a first output terminal and for producing a pulse signal at a second output terminal each time the second switch is set to the first position; and a ring counter circuit comprising a plurality of serially connected shift registers which are driven by the pulse signal from the first signal generating circuit and cleared by the pulse signal from the second output terminal of the second signal generating circuit and a bypass circuit which is connected across at least one of the serially connected shift registers and which is made nonactive depending on the binary level of the output signal from the first output terminal of the second signal generating circuit so that the ring counter circuit is operated in different modes according to the switching position of the second switch, and the control signals for time display and time correction are determined by the output signal from the first output terminal of the second signal generating circuit and from at least one of the output terminals of the ring counter circuit.

2. A circuit according to claim 1 wherein the ring counter circuit further comprises a first AND logic circuit having a first input terminal connected to the first output terminal of the second signal generating circuit, a second input terminal coupled to the output terminal of the last stage shift register and an output terminal connected to the input terminal of the first stage shift register, and the bypass circuit comprises a second AND logic circuit which is connected to receive at a first input terminal a signal in an inverted relationship to the input signal applied to the first input terminal of the first logic circuit, a second input terminal coupled to the output terminal of the last stage shift register and an output terminal connected to an input terminal of one of the shift registers other than the first one.

3. A circuit according to claim 1 wherein the plurality of shift registers comprises three shift registers and the output terminal of the second AND logic circuit is connected to the input terminal of the second stage shift register.

4. A circuit for setting the display mode and the correction mode of an electronic timepiece comprising first and second switches each having first and second switching positions; a first signal generating circuit which generates a pulse signal each time the first switch is set to the second position; a second signal generating circuit responsive to the switching positions of the second switch for producing an output signal having binary logical levels at a first output terminal and for producing a pulse signal at a second output terminal each time the second switch is set to the first position; and a ring counter comprising a plurality of cascade-connected shift registers which are driven by the pulse signal from the first signal generating circuit and cleared by the pulse signal from the second output terminal of the second signal generating circuit, a first AND logic circuit having a first input terminal connected to the first output terminal of the second signal generating circuit and an output terminal connected to the input terminal of the first stage shift register, a second OR logic circuit having a first input terminal connected to the output terminal of the first stage shift register and an output terminal connected to the input terminal of the second stage shift register, a third AND logic circuit having input terminals connected to the output terminal of the second logic circuit and to the first output terminal of the second signal generating circuit, a fourth NOR logic circuit having input terminals connected to the output terminal of the third logic circuit and to selected ones of the output terminals of the shift registers except the first stage shift register and an output terminal connected to the second input terminal of the first logic circuit, and a fifth logic circuit having a first input terminal connected to the output terminal of the fourth logic circuit, a second input terminal coupled to the first output terminal of the second signal generating circuit and an output terminal connected to the second input terminal of the second logic circuit, the first logic circuit being connected to receive at the second input terminal a signal which is in an inverted relationship to a signal applied to the first input terminal of the first AND logic circuit so that the control signals for time display and time correction are determined by the output signals from the first output terminal of the second signal generating circuit and predetermined output terminals of the ring counter circuit.

5. A circuit according to claim 4 wherein said plurality of shift registers comprise three shift registers.

6. A circuit according to claim 4 wherein said first signal generating circuit comprises a first shift register connected to said first switch for inverting and shifting an electric signal produced by the operation of said first switch under control of a clock pulse having a first predetermined frequency, a second shift register for inverting and shifting the output signal from said first shift register under control of the clock pulse having said first predetermined frequency, and a sixth NOR logic circuit having input terminals connected to the output terminals of said first and second shift registers, and wherein said second signal generating circuit comprises a third shift register connected to said second switch for inverting and shifting an electric signal generated in response to the operation of said second switch under control of a clock pulse having a second predetermined frequency, a fourth shift register for inverting and shifting the output signal from said third shift register under control of the clock pulse having said first predetermined frequency, and a seventh AND logic circuit having input terminals connected to the output terminals of said third and fourth shift registers.

7. A circuit according to claim 4 wherein the ring counter circuit generates control signals for setting the display mode and the correction mode of the electronic timepiece through selected ones of the output terminals of the shift registers except the first stage shift register, the output terminal of the second logic circuit and the output terminal of the fourth logic circuit.

8. A circuit according to claim 4 wherein the first, third and fifth logic circuits each comprise an AND gate, the second logic circuit comprises an OR gate, and the fourth logic circuit comprises an AND gate having a plurality of inverters connected to the input terminal thereof.

* * * * *